US006112612A

United States Patent [19]

Seksaria et al.

[11] Patent Number: 6,112,612

[45] **Date of Patent: *Sep. 5, 2000**

[54] MULTI FUNCTION SINGLE LEVER CONTROL FOR LIFT TRUCKS

[75] Inventors: Arun K. Seksaria, Lexington, Ky.; William C. Jones, Jr., Rushville, Ind.

[73] Assignee: Clark Material Handling Company, Lexington, Ky.

[ * ] Notice: Under 35 U.S.C. 154(b), the term of this patent shall be extended for 953 days.

[21] Appl. No.: 08/543,734

[22] Filed: Oct. 16, 1995

Related U.S. Application Data

[63] Continuation of application No. 08/176,869, Jan. 3, 1994, abandoned.

[51] Int. Cl.[7] ..... G05G 13/00

[52] U.S. Cl. ..... 74/471 XY; 180/333; 414/664

[58] Field of Search ..... 74/471 XY; 180/333; 414/5, 662, 663, 664; 244/234, 235, 236, 237

[56] References Cited

U.S. PATENT DOCUMENTS

| | | | |
|---|---|---|---|
| 3,011,739 | 12/1961 | Boyce et al. | 74/471 XY |
| 4,036,321 | 7/1977 | Habiger | 180/333 |
| 4,350,055 | 9/1982 | Pinomäki | 74/471 XY |
| 4,590,339 | 5/1986 | Scott-Jackson et al. | 74/471 XY |
| 4,755,100 | 7/1988 | Schultz et al. | 414/664 |
| 5,316,435 | 5/1994 | Mozingo | 74/471 XY |
| 5,429,037 | 7/1995 | Weber et al. | 74/471 XY |
| 5,497,847 | 3/1996 | Ota et al. | 74/471 XY |
| 5,501,570 | 3/1996 | Mozingo | 74/471 XY |

*Primary Examiner*—David M. Fenstermacher
*Attorney, Agent, or Firm*—Intellprop L.C.

[57] ABSTRACT

A single lever hand control for multiple functions having two distinct axes of movement. In the case of a stand-up, battery powered lift truck having a mast, a carriage with forks raised and lowered on the mast, and the forks side shifted on the carriage, which also can be tilted from vertical, forward or back, the operator stands facing to the side with reference to the direction of travel of the truck. Movement of the control lever right to left from a neutral position relative to the direction the operator is facing controls the forward or reverse direction and the speed of the truck. The mast and carriage operations are controlled by the lever being pushed or pulled by the operator transversely to the direction of travel. The force required to displace the lever in one direction is less than that required in the other consistent with the large muscle groups employed to overcome the respective forces. Movement of the lever is also consistent with the direction of movement being imparted to the particular function being performed consistent with the ergonomics of a stand-up lift truck.

10 Claims, 4 Drawing Sheets

MULTI FUNCTION SINGLE LEVER CONTROL FOR LIFT TRUCKS

This is a continuation of application Ser. No. 08/176,869, filed Jan. 3, 1994, now abandoned.

FIELD OF THE INVENTION

This invention pertains to multifunction controls for electric powered lift trucks and more particularly to a stand-up truck control having a single lever hand control.

BACKGROUND OF THE INVENTION

Operator controls for stand-up, narrow aisle, lift trucks having a single hand lever are desirable because they are easy to operate, take little training to master, improve productivity and are less prone to operator error.

A type of control system for such trucks is one that uses functional switches which the operator can select by pressing a button to condition the electric circuit for the desired function. A manual control is then actuated to cause the resulting movement, such as tilting the forks.

One potential difficulty with this type of control is that it may not always coordinate adequately the physical movement of the control lever with the mental or cognitive activity in selecting the function especially where the single lever also controls forward or reverse and the mast functions as well.

SUMMARY OF THE INVENTION

The present invention pertains to a multifunction single lever control in which the functions are more closely coordinated with the physical movement of the control lever. Different hand, arm and shoulder motions of the operator are associated with two directional axes of movement of the lever in a horizontal plane.

In a preferred embodiment of the invention, the operator is positioned at an angle facing sideways to the direction of travel rather than facing in the direction the truck is travelling, either forward or reverse. The single lever control is accessible to the operator in a standup position with the hand resting comfortably on a grip at about waist level. The two axes of operation, one in the direction of travel, controlling the truck speed and direction, and the other in the direction which the operator is facing, controlling the functions of the mast, are related to the movements they control, e.g., with the operator facing laterally to the direction of travel, right is forward, and left is reverse for causing the truck to travel in the corresponding direction.

Different sets of muscles are employed in operating the lever along one axis as opposed to the other which differentiates the "feel" in the two axes of operation from different reactive forces required by the mechanism. The larger forces will be encountered by the large muscle groups in the operator's back, shoulder and arm in a push-pull motion along the one axis laterally to the direction of travel employed in controlling the mast functions, while the smaller muscle groups of the hand and wrist are employed along the other axis in a right and left rolling motion used for controlling the speed and forward or reverse travel of the truck.

In the particular application of the control on a standup, battery-operated lift truck, the traction motor for propelling the truck in either forward or reverse directions is initiated for drive in one, or the other direction, and a transducer, which requires only a small amount of effort to operate, varies the voltage to the motor and hence the speed of a drive steer wheel. In the case of a standup lift truck, this is a single steerable drive wheel.

The mechanical parts of the control include a multiaxis cradle assembly on which the single hand lever is gimbaled. A shaft rotates with the lever when moved forward or reverse along the one axis generally parallel to the direction of movement of the truck. The shaft in turn rotates a cam that actuates a forward or reverse directional switch. The switch conditions the power circuit to drive the motor in either direction to propel the truck in either a forward or reverse direction. A transducer is operated by the shaft to vary the voltage to the motor and hence, the speed proportional to the displacement of the lever.

The cradle assembly also incudes a collar rotated on the other axis, in the direction the operator is facing, employing the push-pull motion of the lever. The collar rotates a cam that actuates switches which in turn condition the circuit for a selected mast function, e.g., pushing the lever lowers the mast, pulling it toward the operator raises it.

Selector buttons on the grip are provided to isolate portions of the circuit for different mast functions, e.g., side shift or tilt or reach/retract, when the lever is pushed or pulled.

Thus, the invention has as one of its objects a single lever control which more nearly matches the large muscle groups of the operator with the larger reactive forces of the control and the smaller muscle groups with the smaller reactive forces of the control to create less fatigue and higher productivity during long periods of operation of industrial equipment.

A principal object of the preferred embodiment is that the reactive force encountered in producing the travel mode of the truck has a "feel" that requires the least amount of force from the operator, referred to as the "X" direction, while the larger muscle groups of the operator's back, shoulder and arm are employed in a push-pull manner to counteract the larger forces in a "Y" direction producing a distinctly different "feel" for operating the mast functions of the truck.

Another object is to use control movements in a direction aligned with the function being controlled to reduce the learning time for operating the equipment as well as making it more efficient and user-friendly by employing the natural movements of the operator to mimic the same direction in which the controlled function is being performed.

Other objects and advantages of the invention will be more readily apparent by reference to the following detailed description of the control in conjunction with the accompanying drawings, wherein:

DESCRIPTION OF THE PREFERRED EMBODIMENT

Figure 1:
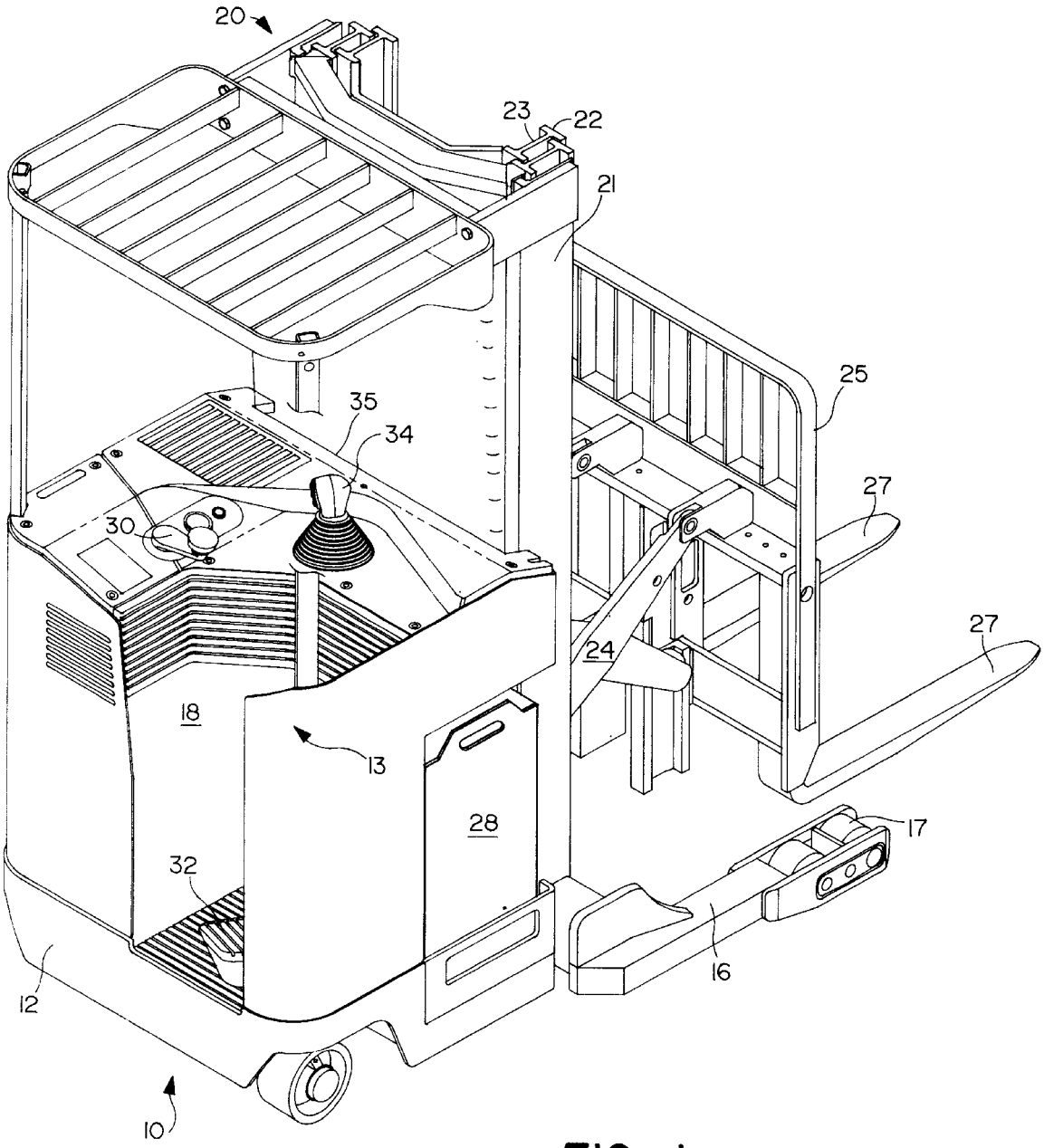
FIG. 1 is a rear perspective view of a standup industrial truck employing the single lever control.

Pictured in FIG. 1 is a powered industrial lift truck referred to in the industry as a standup, narrow aisle, reach truck. The truck (10) has a chassis (12) providing an operator's compartment (13) in which an operator stands when operating the truck. A single drive/steer wheel (not shown) in the rear propels and maneuvers the truck while a pair of outriggers (16), one on each side at the front of the chassis, includes wheels (17) supporting the truck at the front. An integral drive motor and drive gear assembly is mounted within the sheet metal panel (18). A mast (20) has spaced outer fixed rails (21) which receive telescopically, vertically extendable, intermediate and inner rails (22, 23). A pantograph carriage linkage (24) supports a load backrest (25) and carries forks (27) for engaging and lifting a load. The pantograph carriage (24) is raised on the inner rails and the linkage reaches out and retracts. From the position shown in FIG. 1, the linkage will retract the load backrest and forks to the front of the mast (20). When the vertical lift function of the mast is performed, the pantograph carriage, and then the inner rails (23), and the intermediate rails (22) are raised to reach a maximum overall height of about 20 feet. The maximum lift height would vary, depending upon the weight of the battery (28) and the configuration of the mast (20), but typically a triplex mast, as illustrated in FIG. 1, is capable of reaching heights of 21½ feet (approximately 10 meters) with a load of 2,000 pounds (906 kilograms) on standard forks. A tilt cylinder (not shown) is capable of tilting the forks (27) 4° to the rear and 3° to the front from a horizontal plane in which the forks (27) are normally situated so that the tips can slide under a pallet, box, or crate in picking up a load, after which the forks are tilted back and the pantograph linkage (24), if extended, is retracted to the front of the mast (20). Travel speeds vary up to 0–7 mph, with the truck being propelled by the drive wheel in either forward or reverse directions. Steering lever (30) turns the drive wheel. A brake pedal (32), which the operator stands on during travel, is released for parking or emergency braking.

All of the functions of the truck, except braking and steering are controlled from the operator's compartment by a single hand lever (34). A palm shaped grip incorporates a row (35) of selector buttons along the side of the grip within convenient access of the thumb of the operator.

Figure 2:
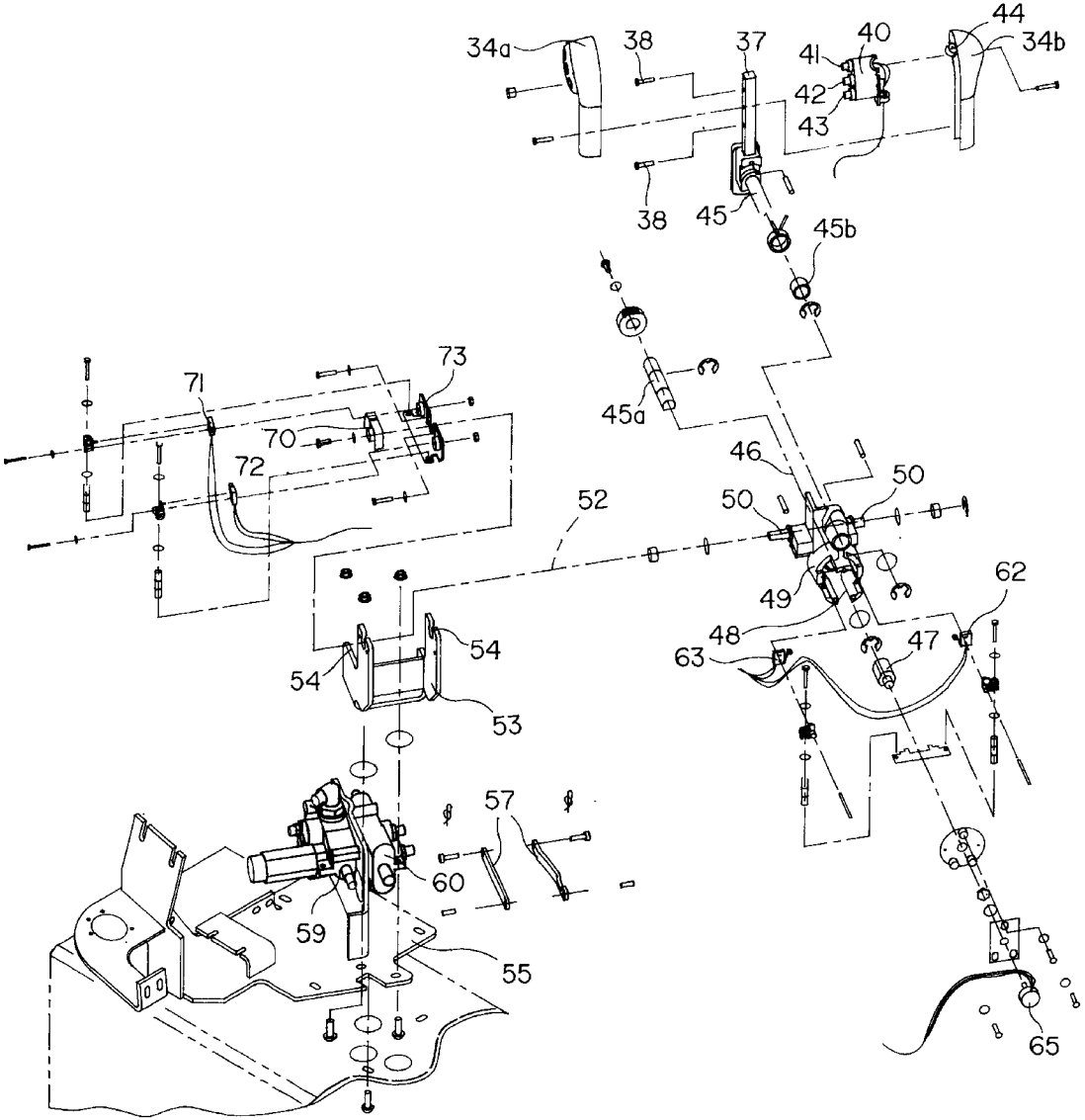
FIG. 2 is an exploded view of the control mechanism.

FIG. 2 is an exploded view of the control mechanism operated by the single lever control handle (34). The grip has mating halves 34*a*, 34*b*, shown separated in FIG. 2 on opposite sides of a rod (37) to which they are secured by fasteners (38) when assembled as pictured in FIG. 1. The row (35) of selector buttons is housed within an electrical unit (40) from which buttons (41, 42, 43) project through one side (34*a*) of the grip so as to be accessible by the operator's thumb when his palm is resting on the grip. The top button (41) controls the reach function of the pantograph, the middle button (42) the tilt function, and the lower button (43) the side shift function of the carriage, as will be more fully described hereinafter. In addition, a horn button (44) is provided on the top of the grip which the operator depresses with the index or middle finger of his hand.

The rod (37) is secured to a shaft (45) which causes rotation of shaft assembly extension (45*a*) biased to a neutral position by spring (45*b*). Shaft assembly extension (45*a*) rotates about axis (46) of an internal bushing (48) in a collar (49) which is gimbaled on pins (50) providing a second shaft which pivot on axis (52) at a substantially right angle to the axis of rotation 46 of the shaft assembly extension 45*a*. A cradle (53) has slots (54) in which the pins (50) pivot. The cradle (53) is secured to a plate (55) mounted to the chassis of the truck. A pair of links (57) are fastened at one end to the collar (49). They are pushed or pulled by rotation of the collar around its axis (52) to operate a pair of hydraulic control valves (59, 60).

Forward or reverse directional switches (62, 63) opposite a cam (47) are actuated by rotation of the shaft (45), shaft assembly extension (45*a*) and cam (47) in either the forward or reverse direction from a neutral position. As shown in FIG. 2, the operator is facing laterally to the direction of travel. Movement of the lever (34) to the right, or to the left, engages either switch (62) or (63), closing its contacts. This conditions the power circuit to drive the motor (74) in one direction or the other for either forward or reverse propulsion of the truck. The operator is facing sideways to the direction of travel such that the movement imparted to the lever (34) is consistent with that same direction of travel imparted to the truck.

A transducer (65) is actuated by rotation of the shaft assembly extension (45*a*) to either the right or left to vary the voltage supplied to the drive motor and thus the speed in either forward or reverse directions.

Figure 3:
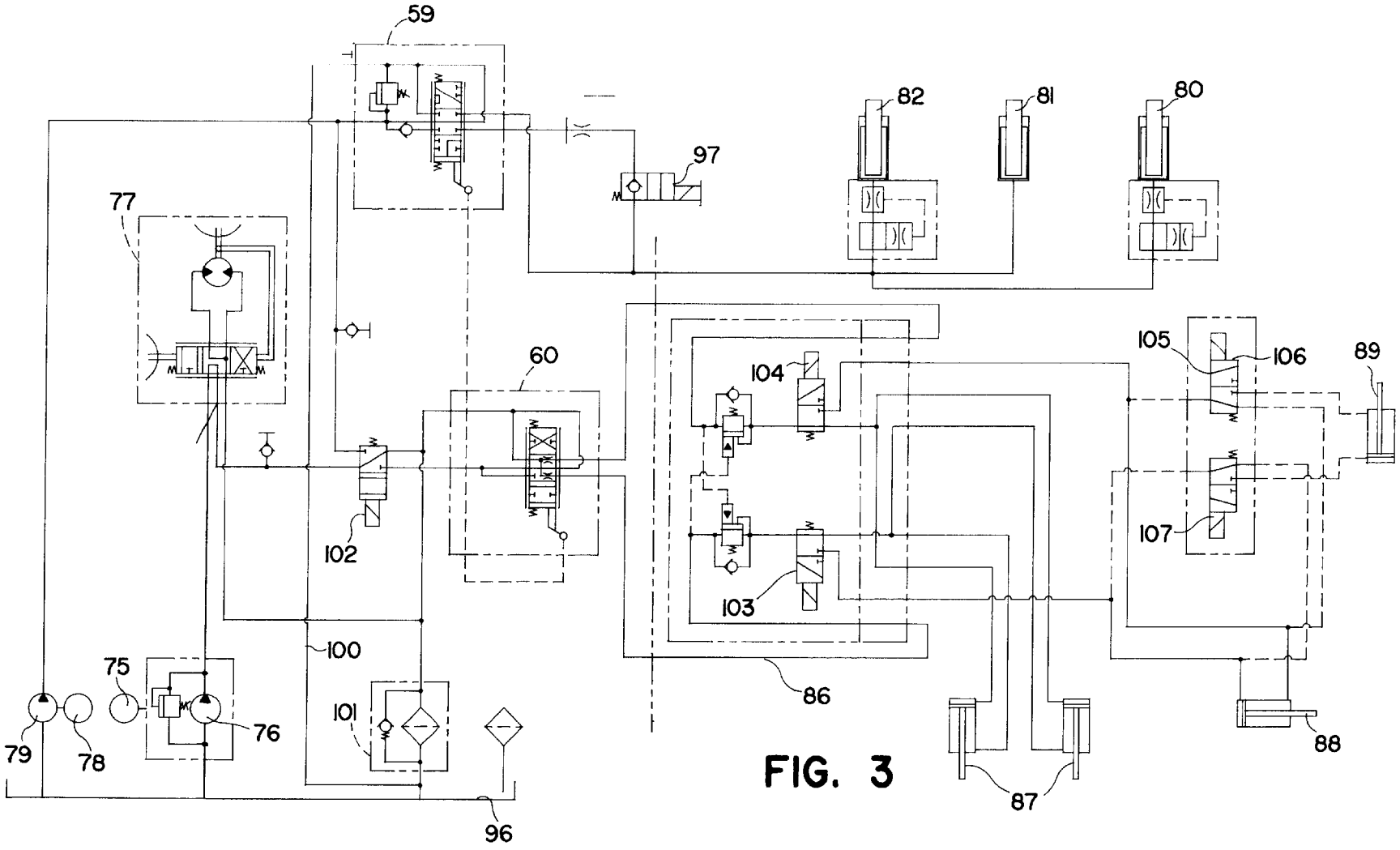
FIG. 3 is a hydraulic circuit diagram of the hydraulic system that is operated by the control in FIG. 2.

A cam (70) is rotated on pivot axis (52) by the collar pin (50) and switches (71, 72) mounted on a carrier (73) opposite the cam (70) will be closed or opened, depending upon the direction of movement of the collar (49) pivoting on axis (52) by push or pull of lever (34) toward or away from the operator. Referring to FIG. 3, steering auxiliary motor (75) drives a pump (76) supplying hydraulic fluid for the steering unit (77). Pump (76) also supplies hydraulic pressure for operating the reach, tilt and side shift functions, controlled by valve (60). A separate lift motor and pump (78, 79) supplies hydraulic fluid under pressure to a control valve (59) for operating the primary lift cylinder 81; and secondary lift cylinders (80, 82) employed in raising and lowering the rails (22, 23) and pantograph carriage (24). Control valve (60) receives hydraulic fluid from pump (76) routed through the steering unit (77) such that any fluid not used for steering is available to be used to operate the mast functions, namely the reach, tilt and side shift through a selector valve (86). Hydraulic fluid routed through steering unit (77) and through valve (60) is sent to the reach cylinders (87) operating the pantograph, and the tilt cylinders 88; and side shift cylinders (89).

Figure 4:
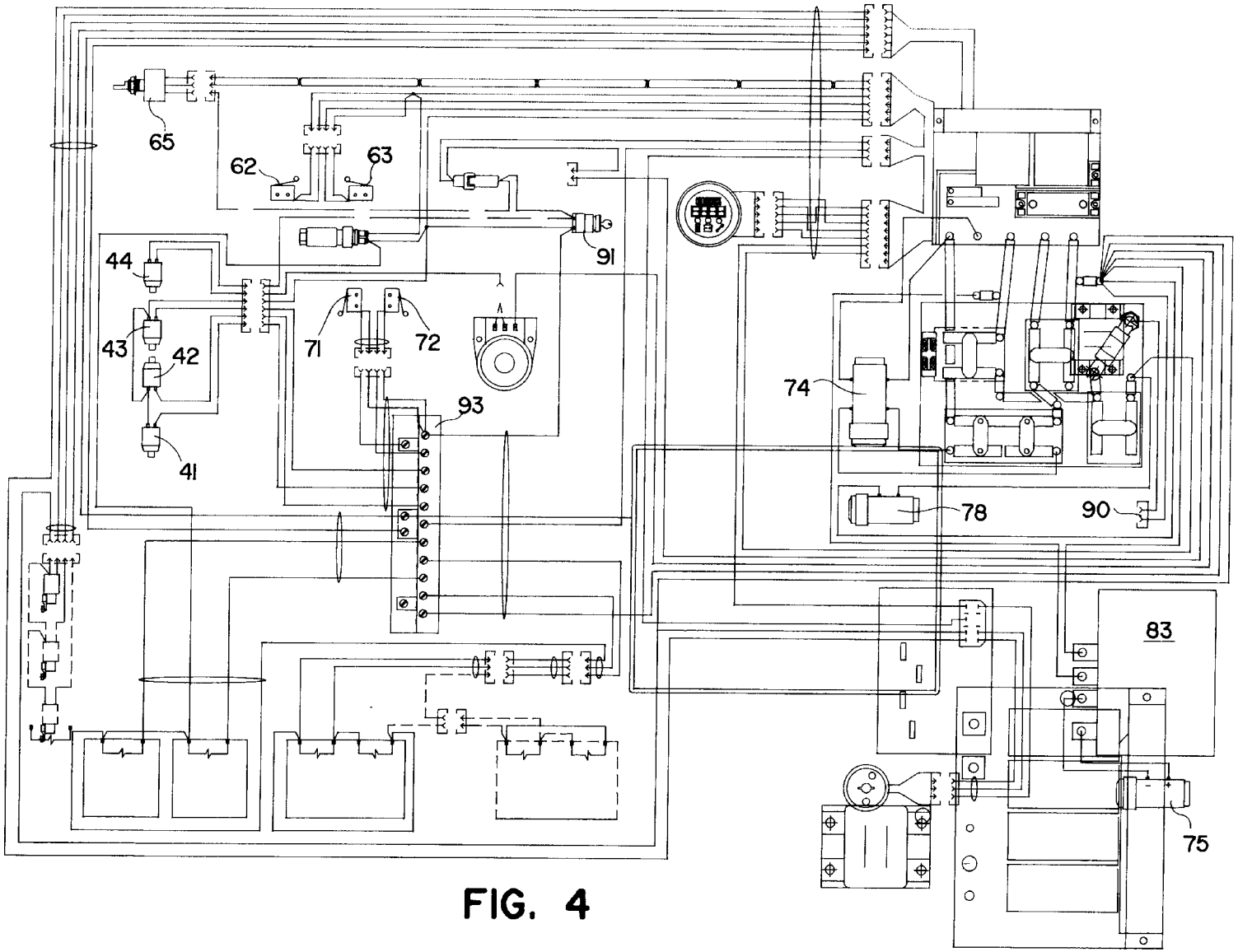
FIG. 4 is an electrical circuit diagram of the truck pictured in FIG. 1.

Referring to the electrical circuit in FIG. 4, with power being supplied by the battery (28) at terminals (90), the power circuit is energized after the ignition switch (91) is closed. When either the switch (62) or (63) is closed, the circuit is conditioned powering for drive motor (74). The amount of voltage applied to the motor (74) is controlled by the transducer (65) which is rotated by the shaft extension (45) to vary the speed.

The lift, lower and other mast functions, reach, tilt, and sideshift are controlled through a solenoid card (93). Depressing a selector button (41, 42, 43) on the grip conditions the control circuit for reach, tilt or sideshift. Movement of the lever (34) away from or toward the operator causes the cam (70) to close either of switches (71 or 72) and in the process, energize the appropriate solenoid. Linkages (57) (FIG. 2) operate the valves (59, 60) to direct hydraulic fluid to the appropriate actuating cylinder. The valve (59) operates the primary lift cylinder 81; and secondary lift cylinders (80, 82) for raising the mast and carriage assemblies. With the lift motor (78) supplying power to the lift pump (79), hydraulic fluid under pressure is supplied to the cylinders by actuating the lift/lower control valve (59). Conversely, hydraulic fluid is returned to the reservoir (96) from the cylinders (80, 81, 82) at a controlled flow rate when the lever (34) is pushed forward by the operator closing the switch (71), which actuates a lowering solenoid valve (97) and the linkage (57) shifts the spool of valve (59) to connect the metered flow to return line (100) and reservoir (96).

The reach function of the pantograph is performed by the operator first depressing the reach button (41) on the side of the grip (34) completing the circuit through the solenoid card (93) to the auxiliary solenoid valve (102). Pushing the lever (34) then closes switch (71) which speeds up the steering auxiliary motor (75) through a solid state control (83) allowing hydraulic fluid from the steering valve (77) to be diverted to the auxiliary valve (60). Linkage (57) shifts the spool of valve (60) in the direction to send hydraulic fluid to double acting reach cylinders (87) causing the pantograph to extend. Movement of the lever (34) toward the operator shifts the spool of valve (60) to connect fluid under pressure to the opposite ends of cylinders (87) causing them to retract the pantograph.

Likewise, for tilting the forks back toward the operator, the tilt button (42) is pressed energizing the auxiliary solenoid valve (102) and tilt solenoids (103) of the selector valve (86). Pulling the lever (34) toward himself, the operator closes switch (72) and linkage (57) shifts the spool of the auxiliary valve (60) so that hydraulic fluid under pressure flows to the end of the double acting tilt cylinder (88) causing the forks to tilt back a few degrees from their normal vertical position.

Similarly, if the operator wishes to tilt the forks forward, he moves lever (34) forward, the linkage (57) shifting the spool of auxiliary valve (60) in the opposite direction causing hydraulic fluid to flow to the opposite end of the tilt cylinder (88) and exhaust the other end to the reservoir.

In a similar fashion, the side shift function of the carriage (24) is controlled by the selector button (43). This button activates through the solenoid card (93) auxiliary solenoid valve (102) tilt solenoids (103, 104) and the side shift control valve (105) having left/right solenoid sections (106, 107). Depending on whether the lever (34) is pushed away from the operator to shift the carriage to the left or pulled toward the operator to shift it to the right, the auxiliary valve (60) is actuated to supply hydraulic fluid to the appropriate end of the shift cylinder (89) and exhaust the opposite end.

The grip on the lever (34) includes the horn button (44) which the operator may depress by simply pushing down with the index or middle finger of his hand to sound the horn.

Thus, a single lever controls multiple functions with the movement of the lever in the direction of the largest control resistance being aligned with the larger muscle groups of the operator used in operating the lever (34). The operation of the valve spools of the lift/lower and the auxiliary control valves (59, 60) by linkage (57) is either pushing or pulling the spool overcoming the spring force. Because the valves pose the greatest resistance to force, the invention provides that these and other control reactive forces are laid out on an axis, referred to as the "Y" axis, for operation by the large back muscles, shoulder and arm in a push-pull fashion. This creates less fatigue and more control, giving the operator better performance of the machine. In contrast, the actuation of the lever (34) to the right or left, as the operator is facing, referred to as the "X" axis, merely has to overcome the force of spring (**45*b*) for controlling the speed once the switch (62, 63**) for either forward or reverse direction is closed.

Moreover, the type of motion in the "Y" axis differentiates the function from the type of action in the "X" direction. The operator simply rolls his hand and wrist to operate the drive control by pivoting the lever (34) to the right or left about its first axis (46). In contrast, a different type of motion is employed along the "Y" axis for push and pull of the lever (34) pivoting around its second axis (52) for the lift, reach, tilt and side shift operations. Thus, not only does the directional movement of the lever (34) coordinate the least reactive force with the smaller muscle group, the motion employed in developing that action is distinctly different, and moreover, is consistent with the human factors orientation of the mechanical operation being performed, namely forward motion of the truck is produced by forward motion of the lever (34) and lift of the mast is produced by a pulling motion of the lever, the operator's perception being of "lifting" the load.

Similarly, the reach/retract of the pantograph is by pushing or pulling on the lever (34), coupled with depressing the selector button (41), the forward or back tilt of the forks is performed by pushing or pulling on the lever (31) coupled with depressing the selector button (42) and the left or right side shift is accomplished by pushing or pulling the lever coupled with selecting the button (43). Thus the human factors are designed not only to simulate the function's movement, but match its ergonomic forces in the "X" and "Y" directions of movement.

The above description of a preferred embodiment of the invention is for purposes of illustration and is not intended to limit the exact form of the invention disclosed, which encompasses equivalent structures for accomplishing substantially the same ends, in substantially the same way, and equivalent applications are contemplated where the control may be used in a variety of machines or vehicles being modified appropriately to the particular equipment, such modifications or variations being well within the scope of the appended claims.

What is claimed is:

1. In a powered industrial lift truck having a stand up operator's compartment designed to orient the operator relative to the direction of travel for ergonomical use of different muscle groups of the operator's body, a first muscle group comprising those that are capable of imparting a rolling motion in a right to left manner relative to the direction the operator is facing to the operator's arm and hand in a first "X" direction of the stand up operator's compartment corresponding to the direction of travel and a second muscle group comprising those that are capable of imparting to the operator's arm and shoulder a push or pull motion in a second "Y" direction corresponding to the direction of the stand up operator's compartment that the operator is facing, the improvement comprising:

powered means for propelling the powered industrial lift truck in either the forward or reverse directions at variable speeds;

a mast mounted on the powered industrial lift truck having a lifting and lowering capability for a load carried by the mast;

a multi function single lever operator hand control in the operator's compartment having a neutral position and two directions of motion therefrom comprising;

a first pivot axis perpendicular to the "X" direction of operator's compartment about which said single lever operator hand control pivots using the first muscle group;

a second pivot axis perpendicular to the "Y" direction of the stand up operator's compartment about which said single lever operator hand control pivots using said second muscle group;

and control means responsive to displacement of said single lever operator hand control in either the "X" or "Y" directions from the neutral position against an ergonomic reaction force acting in the "X" direction which is substantially lighter than an ergonomic reaction force acting in the "Y" direction such that the operator's first muscle group is ergonomically coordinated to the lighter reaction force while the second muscle group is ergonomically coordinated to the larger reaction force in the "Y" direction whereby the operator can sustain longer periods of operation minimizing operator fatigue.

2. In a powered industrial lift truck as set forth in claim 1 where the operator is standing in the operator's compartment facing at an oblique angle to the direction of travel.

3. In a powered industrial lift truck as set forth in claim 1 wherein;

said control means comprises a first shaft pivotable about said first pivot axis;

spring means biasing the first shaft to the neutral position;

said powered means actuated by said first shaft to propel the powered industrial lift truck in either direction;

a second shaft pivotable about said second pivot axis;

a linkage connected to said second shaft for transposing pivotable motion into rectilinear motion; and valve means operated by said rectilinear motion connected to said linkage controlling the raising and lowering of said mast.

4. In a powered industrial lift truck as set forth in claim 3 wherein;

a first cam is rotated by said first shaft; and a pair or switches, one actuated by said first cam when rotated in one direction, and the other when said first cam is rotated in an opposite direction for operating said variable speed controller means.

5. In a powered industrial lift truck as set forth in claim 4 wherein;

said second shaft is pivotally supported below said first shaft, a carrier member fixed on said second shaft, said linkage pivotally connected to said carrier member on one end and to said valve means on an other end, said valve means including at least one valve element, a spring biasing said valve element to a neutral position which also returns said hand control to the neutral position.

6. In a powered industrial lift truck having a stand up operator's compartment designed to accommodate an operator standing in the stand up operator's compartment facing partially sideways in a "Y" direction laterally to the direction of travel of the powered industrial lift truck in either forward or reverse traveling in an "X" direction of the operator's compartment generally perpendicular to the "Y" direction corresponding to either the right or left of the operator;

powered means for propelling the powered industrial lift truck in either the forward or reverse directions at variable speeds;

a mast on the powered industrial lift truck having a lift and lower motion imparted to a load, which motion corresponds to a push, or pull motion of the operator's unsupported arm in the "Y" direction of the stand up operator's compartment and involving in such push or pull motion, a first larger muscle group for effecting such motion, generally in the direction that the operator is facing, and a first larger resistive force associated with said push or pull motion;

a multi-function single-lever operator hand control having a neutral position and two directions of motion therefrom mounted in said stand-up operator's compartment at approximately waist level of the operator, said control comprising;

a first "X" direction of motion corresponding to said "X" direction in the stand up operator's compartment which motion corresponds to a right or left rolling motion of the operator's unsupported arm and involving in said right or left rolling motion, a smaller muscle group for effecting such motion, generally parallel to the direction the operator is facing, and a second smaller resistive force associated with said rolling motion;

a second "Y" direction of motion; corresponding to the "Y" direction of the stand up operator's compartment;

said first "X" direction of motion comprising a human factors rolling action of the operator's hand and unsupported arm for controlling the direction of travel and speed of the powered industrial lift truck;

and;

a control means responsive to displacement of said single-lever hand control from the neutral position in either the "X" or "Y" directions, said control means comprising means rotatable about an axis approximately parallel to the operator's unsupported arm and perpendicular to the "X" direction of motion for varying the speed and direction of said powered means operable by the human factors rolling action of the operator's hand and unsupported arm as controlled by said second smaller muscle group, and second means rotatable about an axis generally perpendicular to said first rotational axis being operable by the human factors push or pull action of the operator's unsupported arm moving in said "Y" direction of motion involving said first larger muscle group thereby minimizing operator fatigue due to prolonged operation by matching the larger and smaller muscle groups with the larger and smaller resistive forces.

7. In a powered industrial lift truck having a stand up operator's compartment as set forth in claim 6, wherein;

said single-lever control pivots on a first axis that extends perpendicular to said "X" direction in the operator's compartment in a right or left rolling motion of the operator's unsupported arm and said single-lever control independently pivots about a second axis perpendicular to said "Y" direction of the operator's compartment in either a push or pull motion of the operator's unsupported arm.

8. In a powered industrial lift truck as set forth in claim 7, wherein;

said control means comprises a first shaft rotated by said single-lever hand control on said first axis;

a first cam rotated by said first shaft;

a first pair of switches, one actuated by said first cam when rotated in one direction, the other when said first cam is rotated in an opposite direction;

a variable speed control means varied by rotation of said first shaft in either direction;

a second shaft rotated by said single-lever hand control on a second axis;

a second cam rotated by rotation of said second shaft;

a second pair or switches, one actuated by said second cam when rotated in one direction, the other when the second cam is rotated in the opposite direction.

9. In a powered industrial lift truck as set forth in claim 8, wherein;

said control means includes a selector switch actuated by the operator from the single-lever hand control in the "Y" direction to select different operations of the mast of the truck.

10. In a powered industrial lift truck as set forth in claim 9, wherein;

a plurality of selector switches are arranged in a row on the single-lever hand control positioned so as to be operable by the operator.

* * * * *